US005816740A

United States Patent [19]

Jaszkowiak

[11] Patent Number: 5,816,740

[45] Date of Patent: Oct. 6, 1998

[54] HYDRAULICALLY CONTROLLED STEERING FOR POWER TROWEL

[76] Inventor: Timothy S. Jaszkowiak, 2229 Cribbens St., Boise, Id. 83713

[21] Appl. No.: 788,819

[22] Filed: Jan. 23, 1997

[51] Int. Cl.[6] ..... E01C 19/22

[52] U.S. Cl. ..... 404/112

[58] Field of Search ..... 404/112; 280/6.12; 180/116, 117, 118

[56] References Cited

U.S. PATENT DOCUMENTS

| | | | |
|---|---|---|---|
| 4,046,484 | 9/1977 | Holz, Sr. et al. | 404/112 |
| 4,775,306 | 10/1988 | Kikuchi et al. | 425/62 |
| 5,108,220 | 4/1992 | Allen et al. | 404/112 |
| 5,480,258 | 1/1996 | Allen | 404/112 |
| 5,584,598 | 12/1996 | Watanabe et al. | 404/112 |
| 5,613,801 | 3/1997 | Allen | 404/112 |

*Primary Examiner*—Tamara L. Graysay
*Assistant Examiner*—Gary S. Hartmann
*Attorney, Agent, or Firm*—Frank J. Dykas

[57] ABSTRACT

A self-propelled power trowel, for finishing a concrete surface, is provided, having a rigid frame adapted to be disposed over a concrete surface, an engine assembly, and at least a pair of rotor assemblies having rotatable trowel blades. The rotor assemblies are tiltable relative to the frame. Dual-action hydraulic cylinders are provided interconnected between the frame and the rotor assemblies for selectively tilting the rotors to provide steering control to the power trowel. The hydraulic fluid is delivered to the cylinders at variably selectable but constant pressures through the proportional pressure output control valves.

4 Claims, 6 Drawing Sheets

FORWARD

REVERSE

SWING RIGHT

SWING LEFT

CRABBING TO RIGHT

CRABBING TO LEFT

HYDRAULICALLY CONTROLLED STEERING FOR POWER TROWEL

BACKGROUND OF THE INVENTION

TECHNICAL FIELD

This invention generally relates to hydraulic steering control systems for riding power trowels, and more particularly to a hydraulic steering control system which utilizes proportional output hydraulic valve control.

BACKGROUND

Riding power trowels are used for finishing concrete surfaces as the concrete is curing and hardening. A typical riding power trowel is a two-rotor device, with each rotor typically having four troweling blades extending out in radial fashion, and usually configured such that the tips of the blades of each rotor intermesh to provide for a continuous finishing of the concrete surface below the riding trowel. There is provided a rigid frame which houses the blade assemblies, and also an engine, usually a gasoline or diesel engine, which provides the motive power for the blades. Atop of the engine and the frame assembly is found an operator's seat and the necessary control systems and levers for operation of the machine. These machines are manufactured in a variety of sizes and weights, with the largest of these machines having not just two, but rather three, rotor and troweling blade assemblies.

Good examples of these riding power trowels can be found in U.S. Patents to Holz, Sr. et al., U.S. Pat. Nos. 3,936,212, issued Feb. 3, 1976, and 4,046,484, issued Sep. 6, 1977. Additional examples of these prior art machines are disclosed in U.S. Patents to Allen et al., U.S. Pat. Nos. 5,108,220 issued Apr. 28, 1992 and 5,238,323 issued Aug. 24, 1993.

For purposes of this prior art section and the entire specification, a two-rotor machine will be used as an example of the steering control and the prior art methods of accomplishing it. In two rotor machines, both rotor assemblies rotate in opposite directions, one to the other. This is shown in prior art FIG. 1.

In prior art FIG. 1, there is shown a two-rotor assembly, wherein each rotor has a gear box and troweling blade assemblies which rotates around the axis of rotation, identified as $A_{RL}$ for axis of rotation for the left rotor, and $A_{RR}$ as the axis of rotation for the right rotor assembly. Left and right L-shaped control arms are provided, which are pivoted for rotation in a fore and aft direction relative to the frame. For example, as the left control arm is pushed forward, its lower horizontal portion of the L-shaped control arm rotates downwardly, pushing down on the front end of the left control lever. The left control lever is hinged at the rear to the power trowel frame. The left control link angles downward with the lever, thereby tilting the left rotor assembly inwardly. In a like manner the right control arm, if pushed forward, will result in a downward motion of the right control lever, and along with the right control link, tilting the right rotor assembly inwardly. With both the right and left rotor assemblies tilted inwardly, given the counter-rotational directions of each of the blade assemblies, a motive force will be generated to move the power trowel in a forward direction.

Likewise, if both the right and left control arms are pulled back, the left and right control levers will rotate upward, resulting in the left and right blade assemblies both tilting outwardly, to generate a motive force for movement of the power trowel in a backwards direction.

In the prior art, if the left control arm is pushed forward to tilt the left rotor assembly inwardly, and the right control arm is pulled back to tilt the right rotor assembly outwardly, then motive forces are generated to swing the entire assembly to the right. Likewise, if the left control arm is pulled back to tilt the left rotors outwardly and the right control arm is pushed forward to tilt the right rotor assembly inwardly, the entire machine assembly will swing to the left In addition, the typical prior art power trowel also provides for at least one of the rotor assemblies, usually the right rotor assembly, to be tiltable both forward and aft by means of the right control arm being capable of being pushed either to the left or to the right. In the prior art FIG. 1, this is accomplished by means of an extension on the right control arm, which is attached to the right pitch control linkage. If the right rotor assembly is tilted to the aft and the left control rotor assembly is left flat to the surface being troweled, the entire machine will crab to the right, and if the right rotor assembly is tilted forward, the entire machine will crab to the left.

With training and practice, an operator can become quite skilled at steering the prior art riding power trowel in just about any direction required.

A complete description of a number of prior art embodiments of this steering, and the mechanics of how this is accomplished, are contained in the above-referenced patents, the teachings of which are hereby incorporated by reference.

The problem with the prior art steering linkage assemblies as shown in the prior art is the result of the combination of two factors, which in combination result in significant operator fatigue with a result being a decrease in efficiency, performance, and results in a possible safety hazard.

First, these machines are relatively heavy. The smallest of the prior art riding power trowels currently being manufactured weighs approximately 400 pounds. The heaviest can easily weigh upwards of 1700 pounds. When an operator's weight is added to the machine, for example between the range of 150 to 250 pounds, the actual weight of the machine, together with the weight of the operator, will range between 550 and 1950 pounds.

The second factor is that it is most desirable to begin finishing the concrete while it is still wet and soft. The sooner the power trowel can be placed in operation on the wet concrete surface, the more quickly and better the finishing operation can be accomplished. This poses a problem. The normal operating speed for a riding power trowel is approximately 150 rpm, however, this operating speed is too fast for use on wet concrete. As a result, the operating speeds are usually significantly slowed down when concrete is wet, and gradually increased as the concrete dries and cures. In the prior art, the typical low usable operating speed for the power trowel is approximately 90 rpm. At higher operating speeds, the wet concrete may splatter and cause problems in finishing.

At high operating speeds and drying concrete, there is considerably more friction between the rotating troweling blades and the concrete. Therefore, at high operating speeds, just a little bit of force generated by just a little bit of tilting of the rotor assemblies results in acceptable steering control. However, with soft wet concrete at low operating speeds, it takes considerably more tilt to generate the required steering forces from the tilted rotor assemblies. When the troweling machine and its operator together collectively weigh upwards of 1950 pounds, maintaining steering control takes considerably more force at slow operating speeds than at high. The same is true when the machine has been temporarily shut down and is at rest. When the operator reseats himself on the machine in order to reposition the trowel, for example, to recover it off of the finished concrete and the blades are rotating slowly, the operator has to apply enough force to the control arms, such that the tilted rotor assemblies literally are lifting the machine off the concrete in order to rotate it.

As a result, in the prior art, considerable design effort has been undertaken to gain the maximum possible mechanical advantages through leveraging of the control arms and levers. A specific example of this design effort is shown, and claimed, in the prior art patent to Allen et al., U.S. Pat. No. 5,108,220, issued Apr. 28, 1992.

Efforts have been made in the prior art to utilize hydraulic cylinders to lever the rotor and trowel blade assemblies into the various tilted positions. However, in the prior art, all of these systems, as known to the inventor, are of the "on or off" type. That is to say, there is a hydraulic pump connected through a control valve which ports hydraulic fluid to one or the other sides of the dual-action cylinders. The problem with this is that it results in a rotor being either fully tilted or fully flat. This is not acceptable, since when the machine is operating at high speed in high-friction conditions, only a slight amount of tilt or pressure from the troweling blades of the tilted rotor is needed to generate the necessary motive or turning forces. Yet, in other conditions, for example, low operating speeds on wet concrete, much more tilting is required to generate the required motive forces.

Accordingly, what is needed is a hydraulic control system for tilting the severs which is capable of fine adjustment to produce minimal tilt angles for the rotor assemblies when operating at high speed on drying concrete, and also capable of generating maximum forces and maximum tilts of the rotor assemblies for tilting and steering control of the machine when operating at its slowest speed, either on wet concrete, in close or dangerous proximity to obstructions, or when repositioning or reorienting the power trowel in preparation for retrieval from the concrete surface.

DISCLOSURE OF INVENTION

The hydraulically controlled steering power trowel is formed of basic sub-assemblies, including a rigid frame, engine assembly, operator seat and blade pitch control systems, all of which are well known in the art. Also included are a left control post and a right control post which house, respectively, a left control valve assembly and a right control valve assembly. In the preferred embodiment both the left and right control valve assemblies are proportional pressure output hydraulic valves which are joystick actuated. These valves are capable of delivering and maintaining a selectable pressure to a dual-action hydraulic cylinder, which in the preferred embodiment would fall in the range of 5 to 200 pounds, although it could be other hydraulic pressure ranges.

The left control assembly is operably connected to a dual action tilting cylinder. The dual action tilting cylinder is operably interconnected between the frame of the power trowel and the left rotor assembly, and is used to adjust the tilt of the left rotor assembly either inwardly toward the center line of the frame, or outwardly away from the center line of the frame. The left control valve assembly is a single-action proportional pressure output valve which is operable to maintain a selectable hydraulic pressure within one or the other sides of the left dual-action hydraulic cylinder and is operably connected to the left rotor assembly to provide a tilting, either in or out from center line movement for the left rotor assembly.

Hydraulic power is provided by a standard hydraulic pump which is operably connected to the trowel engine.

As previously stated, the left rotor assembly is only tiltable in and out from the center line. This is achieved by use of a universal drive assembly which is provided to interconnect the output drive shaft of the engine assembly to the rotor assembly. The universal drive assembly is capable of allowing the tilt motion for the left rotor either in or out relative to the center line of the power trowel.

In a like manner, the right rotor assembly is interconnected by means of a dual-action universal assembly to the output drive assembly of the engine, and is therefore tiltable not only in an in and out direction relative to the center line, but also capable of being tilted either in a forward or aft direction. The right rotor assembly is provided with a right lever tilt post and a right forward and aft tilt post. Attached to the right lever tilt post is a dual action right tilt cylinder which is interconnected between the frame and the right tilt lever. In a similar manner, a second dual-action cylinder, the right forward and aft tilt cylinder, is interconnected to the right forward and aft tilt post and is anchored to the frame. The right control valve assembly is a dual action control system, and is operable to maintain a selectable hydraulic pressure in either side of both the right tilt cylinder and the right forward and aft cylinder, thus controlling not only the tilt of the right rotor assembly, but also its forward and aft.

Both left and right control valve assemblies are fitted with joysticks which are configured such that if they are pushed forward, both rotor assemblies will tilt inwardly to move the power trowel forward, and conversely, if tilted backward toward the operator, they will operate to tilt the rotors outwardly to move the machine backward. The purpose of this configuration is to provide for more intuitive control over the movement of the power trowel.

The purpose of the proportional pressure output control valves is to compensate for the varying tilting requirements which are dependent upon rotor speed and the surface conditions of the concrete being troweled. While the total hydraulic pressure required will vary depending upon the size and weight of the power trowel, it is found in practice that a hydraulic pump producing pressure in the range of 225 to 275 pounds, at an appropriate flow rate, is adequate for an average size dual rotor power trowel being controlled by proportional pressure output control valves controlling within the range of 5 pounds to 200 pounds.

BEST MODE FOR CARRYING OUT INVENTION

Figure 1:
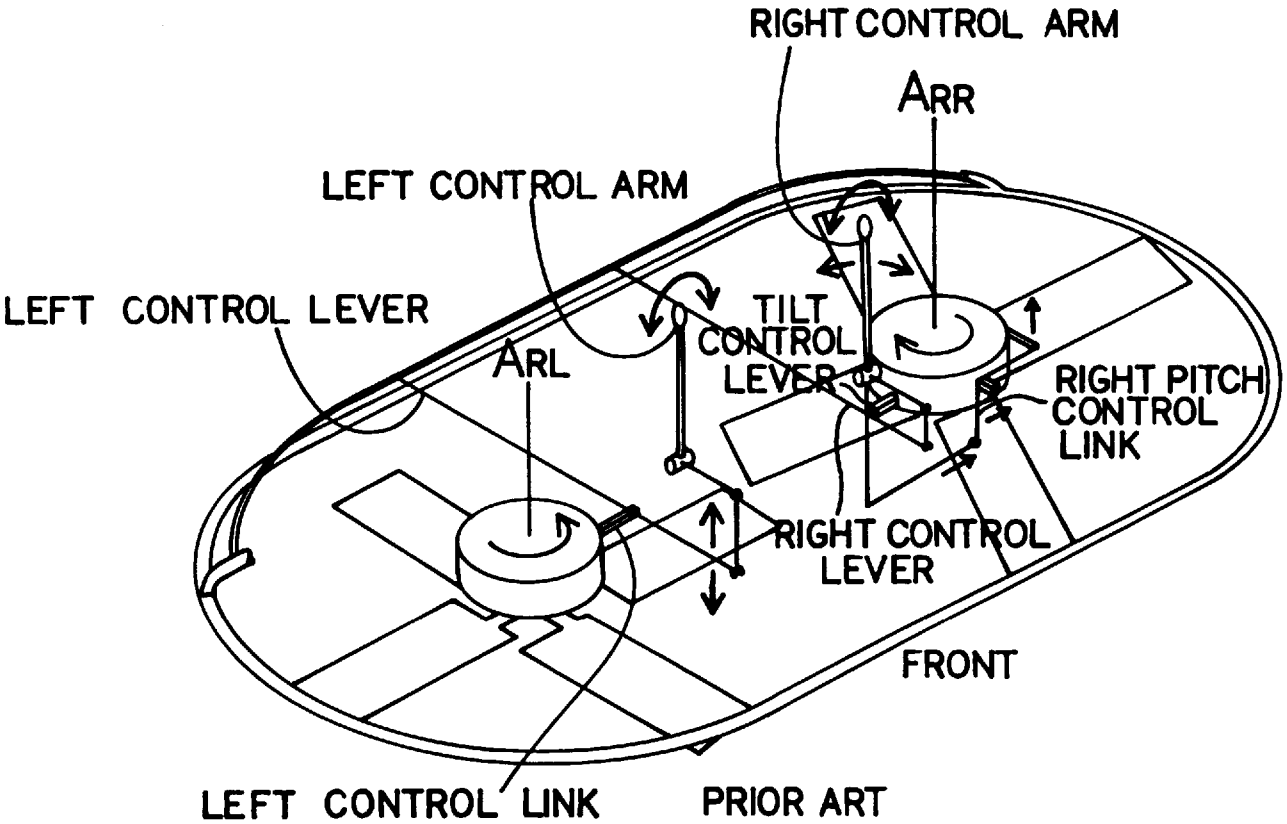
PRIOR ART FIG. 1
FIG. 1 is a prior art schematic representation of a mechanical control system for a two-rotor power trowel.
Figure 2:
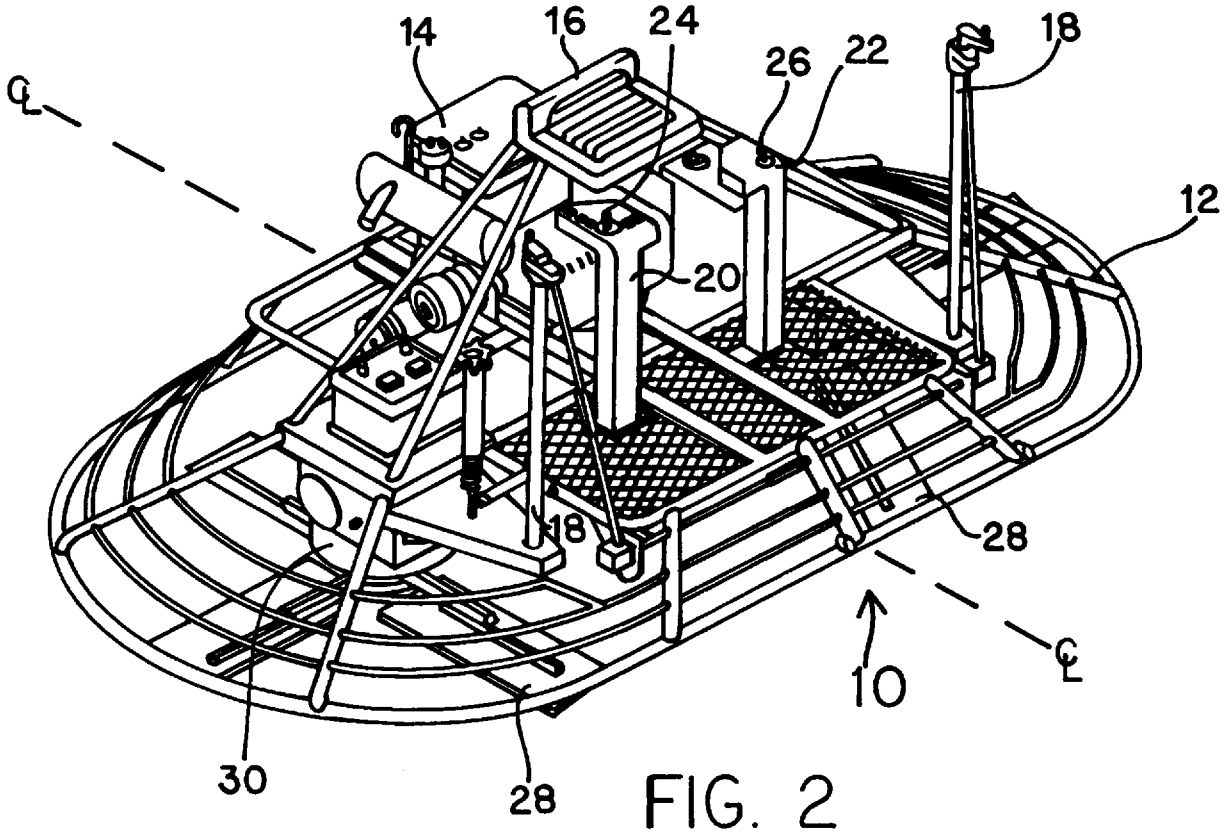
FIG. 2 is a perspective representational drawing of the new hydraulically controlled steering power trowel.

FIG. 2 shows in representational format my new hydraulically con-rolled steering power trowel 10 and its basic sub-assemblies, including frame 12, engine assembly 14, operator seat 16, and blade pitch control systems 18 for blades 28. Also included are left control post 20 and right control post 22, which house respectively, left control valve assembly 24 and right control valve assembly 26. In both preferred embodiments, left control valve assembly 24 is a proportional output, joystick operated, hydraulic valve, which is capable of obtaining a wide range of selectable hydraulic pressures within either side of a dual-action hydraulic cylinder which is operable to tilt the left rotor assembly 30 in or cut toward the center line of hydraulic steering control trowel 10. A suitable left control valve assembly 24 is manufactured by Husco and is identified as Husco Model 7470A15.

Right control valve assembly 26 is a dual action proportional pressure output valve which is operable to maintain a selectable hydraulic pressure within one or the other sides of two dual action hydraulic cylinders, and is operably connected to the right rotor assembly 32 to provide a tilting, in or out from the center line, movement, to right rotor assembly 32, and also a fore and aft tilting movement to the right rotor assembly 32. A suitable dual-action proportional output pressure valve is also manufactured by Husco, and is identified as Husco Model No. 7480-19.

Not shown in the drawings are the hydraulic pump, and the hydraulic hoses and fittings which interconnect both left and right control valve assemblies 24 and 26 to left and right tilting cylinders 44 and 46, as well as right pitch cylinder 48. These portions of the hydraulic system are all well known in the art, and play no part in the present invention, as it is well known how to interconnect a hydraulic pump to the engine assembly 14, as well as how to interconnect the output of the hydraulic pump to dual-action cylinders. However, in the preferred embodiment, the output of the hydraulic pump is selected to be within the range of 225 pounds to 275 pounds, and the pressure-sensitive proportional hydraulic control valves 24 and 26 are capable of maintaining cylinder pressure within the approximate range of 5 pounds to 200 pounds. These pressure ranges have been empirically determined for this best mode embodiment. Other hydraulic pressure ranges may work equally well in other configurations.

It should also be noted that the preferred embodiments utilize dual action hydraulic cylinders, the same results may be achieved utilizing paired single action cylinders.

Figure 3A:
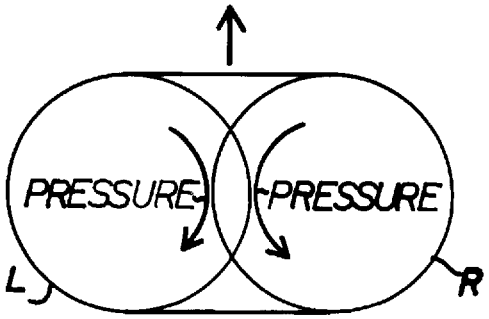
FIGS. 3A through 3F are diagrammatic indications of the different basic movements of the power trowel indicating the direction of rotation of rotors and the points at which increased downward pressure is applied by operation of the hydraulic steering control system.
Figure 3B:
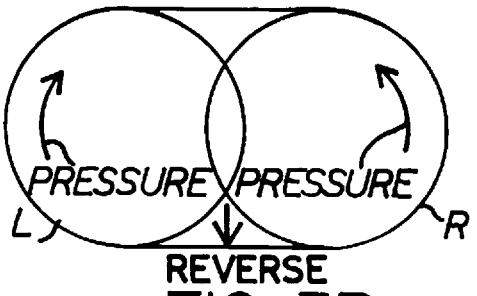
Figure 3C:
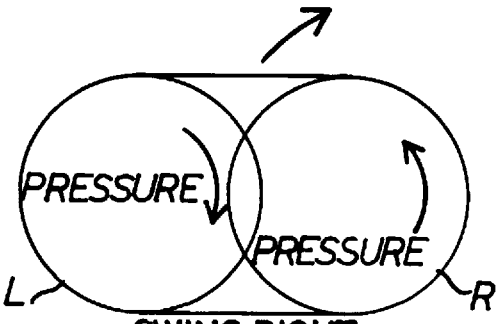
Figure 3D:
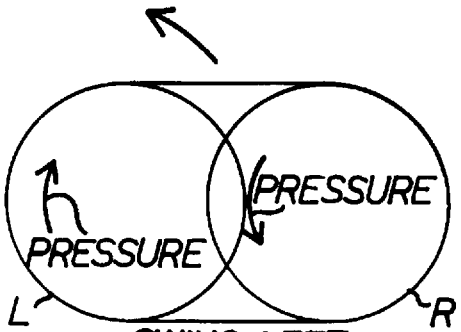
Figure 3E:
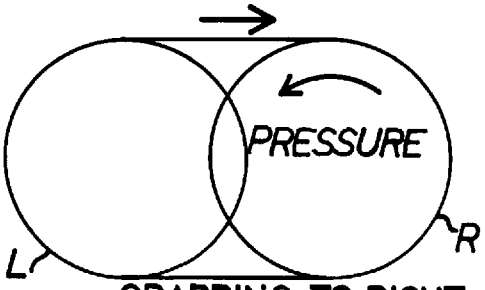
Figure 3F:
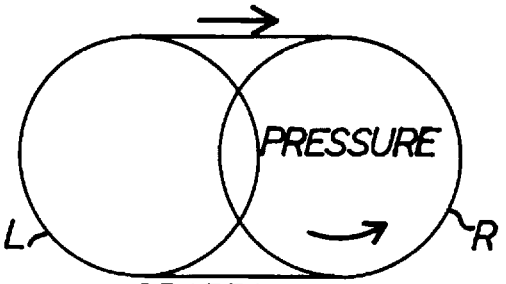
Figure 4:
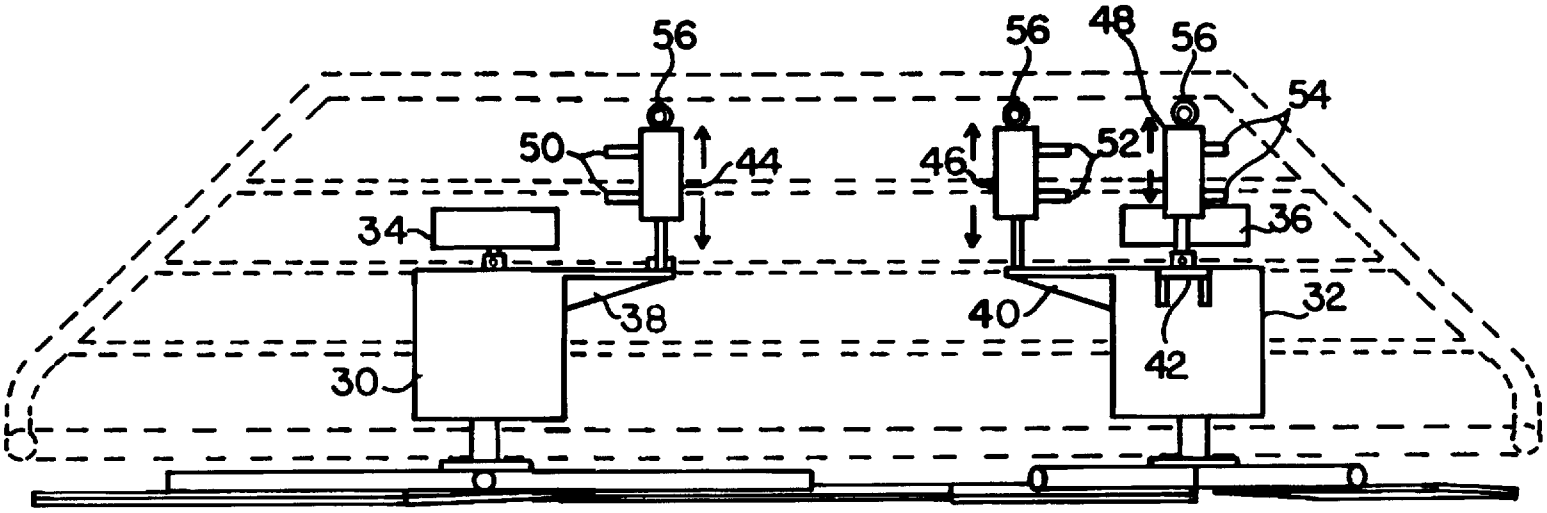
FIG. 4 is a sectional representational front view showing the rotor assemblies and the hydraulic cylinder assemblies of the hydraulic steering control system in a first embodiment.

FIGS. 3A through 3D are diagrammatic indications of the different basic movements of power trowel 10, which can be achieved by tilting left rotor assembly 30 and right rotor assembly 32, either in or out from the center line of power trowel 10. In FIG. 3A, if both rotors are tilted inward to apply increased pressure to rotor assemblies at the center line of power trowel 10, the resultant forces will move the power trowel in a forward direction. Likewise, if both rotors are tilted outward to apply increased pressure to the rotor assembly away from the center line, then power trowel 10 will move in the reverse direction, as shown in FIG. 3B. In FIG. 3C, if pressure is applied to the right side of each of the rotors, it will cause the power trowel to swing to the right. Conversely, as shown in FIG. 3D, if pressure is applied to the left side of the rotors by tilting each to the left, then power trowel 10 will swing to the left.

Right rotor assembly 32 is also fitted with right forward and aft cylinder 48, which tilts right rotor assembly 32 either fore or aft. If right rotor assembly 32 is tilted to apply pressure to the forward portion of right rotor assembly 32, the machine will crab to the right. Conversely, if right rotor assembly 32 is tilted aft to apply pressure to the back of the rotor assembly, power trowel 10 will crab to the left. It has been found in practice that there is no need to provide a forward and aft tilt feature to both rotor assemblies, since the capability of forward and aft tilting either one or the other rotor assemblies is sufficient to provide the necessary motive forces to crab the power trowel either to the left or to the right. However, it should be distinctly understood that hydraulically forward and aft tilting either the left or the right or both rotors falls within the scope of this invention. It is merely the best embodiment known to the inventor which provides for forward and aft tilting of only the right rotor assembly.

It should also be noted that steering control achieved by tilting rotor assemblies is generally known in the art. Reference is made to U.S. Patent to Holz, Sr. et al., U.S. Pat. No. 4,046,484, issued Sep. 6, 1977, the teachings of which are herein incorporated by reference.

Next, referring to FIGS. 3A through 3F and FIG. 4, it can be seen how tilting control of rotor assemblies 30 and 32 is achieved in a first preferred embodiment. In the preferred embodiment, left rotor 30 is only tiltable in and out from the center line. To achieve this, universal drive assembly 34 is provided to interconnect the output drive shaft of engine assembly 14 to rotor assembly 30. Universal drive assembly 34 is capable of allowing tilt motion for left rotor assembly 30 either in or out relative to the center line of the power trowel 10. Attached to rotor assembly 30 is left tilt lever post 38. Interconnected between trowel frame 12 and left tilt lever post 38, is dual action cylinder 44. Dual action cylinder 44 is itself hydraulically interconnected to left control valve assembly 24 by means of hydraulic lines 50. Left hydraulic control valve assembly 24 is operable to supply and maintain hydraulic fluid on either side of dual action cylinder 44 at any preselected pressure between the range of 5 pounds to 200 pounds.

In a like manner, right rotor assembly 32 is interconnected by means of a dual action universal assembly 36 to the output drive assembly of engine 14, and is therefore tiltable not only in an in and out direction relative to the center line, but is also capable of being tilted either in a forward or aft direction. Right rotor assembly 32 is provided with right lever tilt post 40 and right pitch tilt post 42. Attached to right lever tilt post 40 is dual action right tilt cylinder 46, which is connected to frame 12 at anchor point 56. In a similar manner, dual action right forward and aft tilting cylinder 48 is interconnected to right pitch tilt post 42, and anchored at its anchor point 56 to frame 12.

Right control valve assembly 26, as previously stated, is a dual action control system, and is operable to maintain a selectable hydraulic pressure in either side of both right tilt cylinder 56 and right forward and aft cylinder 48, within the range of 5 pounds to 200 pounds, thus is operable to control not only the tilt but the forward and aft tilt of right rotor assembly 32.

Figure 5:
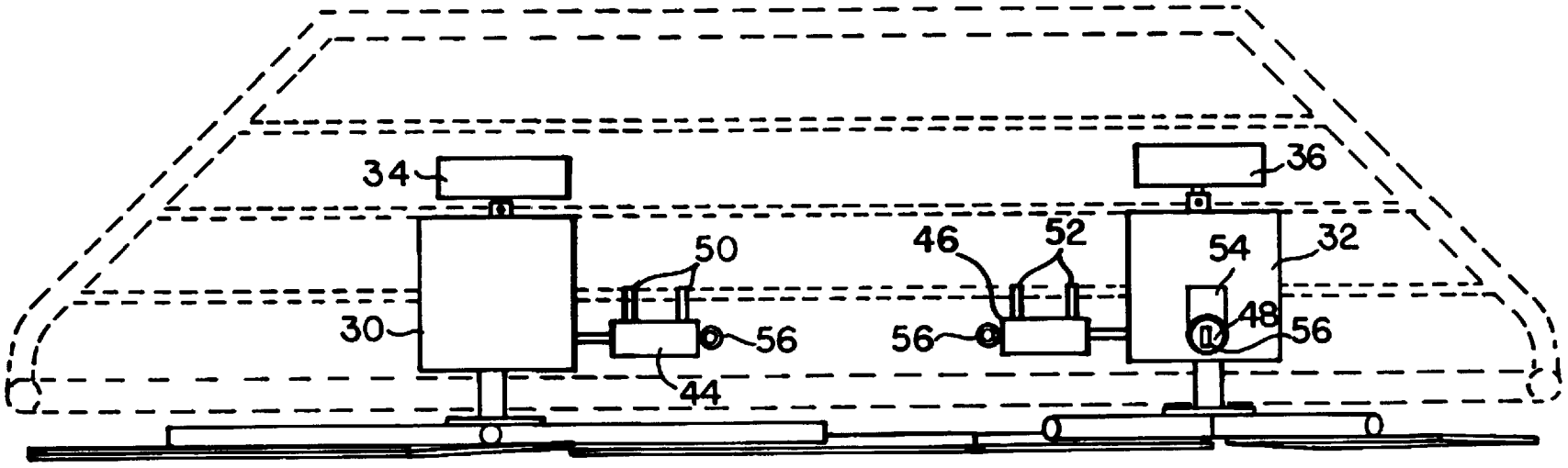
FIG. 5 is a sectional representational front view showing the rotor assemblies and the hydraulic cylinder assemblies of the hydraulic steering control system in a second embodiment.
Figure 6:
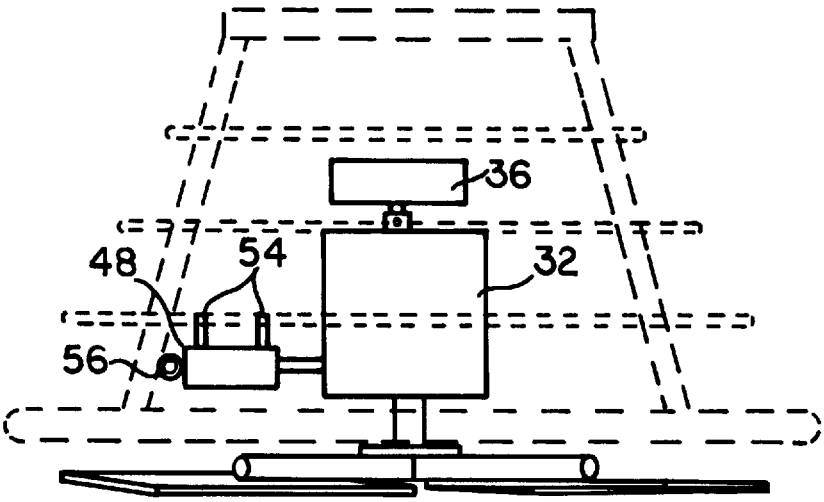
FIG. 6 is a sectional representational side view showing the rotor assemblies and the hydraulic cylinder assemblies of the hydraulic steering control system in a second embodiment.

In FIGS. 5 and 6 there is disclosed a second preferred embodiment in which tilting lever posts 38, 40 and 42 are eliminated. It has been found in practice that hydraulic cylinders 44, 46 and 48 can be directly connected to the rotor assemblies 30 and 32 as is representationally shown in FIGS. 5 and 6.

In operation, in the preferred embodiments, both left and right control valve assemblies 24 and 26 are fitted with joysticks, which are configured such that if they are pushed forward, it will tilt the rotors inwardly to move the power trowel forward, and conversely if the joysticks are tilted back toward the operator, will tilt the rotors outwardly to move the machine backward. The purpose of this configuration is to provide for more intuitive control over the movement of the power trowel.

The purpose of providing proportional pressure output control valves is to compensate for varying tilting requirements which are dependent upon rotor speed and the surface conditions of the concrete being troweled, as has been previously stated in the background section of this specification. For example, if the machine is at rest, on hard concrete, and the operator desires to slowly rotate it around 90 degrees in preparation for its removal from the concrete surface, the hydraulic system must be capable of delivering enough hydraulic pressure to the cylinders to tilt the rotors and literally lift the machine up onto the trowel blades and off of the concrete as it slowly rotates around. Similarly, this large amount of hydraulic force is also required in situation where the blades are rotating slowly over soft, wet concrete. Yet, during the troweling operation when the machine is operating at maximum troweling speed over fairly hard, curing concrete, only minimal tilting is required in order to maintain directional control over the machine, and as a result, the hydraulic control system must be capable of maintaining precise, low-pressure hydraulic control of the cylinders.

It should also be apparent to those skilled in the art that the positioning and configuration of the hydraulic cylinders is simply a matter of design choice. In the preferred embodiment as shown in this specification, the cylinders are vertically oriented. They could just as easily be horizontally oriented and still achieve the same functional results.

While there is shown and described the present preferred embodiment of the invention, it is to be distinctly understood that this invention is not limited thereto but may be variously embodied to practice within the scope of the following claims.

I claim:

1. A self propelled power trowel, for finishing a concrete surface, which comprises:

rigid frame means adapted to be disposed over said concrete surface, said rigid frame means having a front and a rear and defining a centerline from front to rear:

engine means for powering said power trowel attached to the frame means;

a pair of rotor assemblies for frictionally contacting said concrete surface and supporting said frame means thereabove, tiltably connected to the frame means and operably connected to the engine means;

at least three dual action hydraulic cylinders, with one of said dual action hydraulic cylinders operably interconnected between the rigid frame and each rotor assembly for selectively and independently tilting each rotor assembly toward and away from the centerline of the frame, and the third dual action hydraulic cylinder operably interconnected between the rigid frame and one of the rotor assemblies for tilting said rotor assembly fore and aft, parallel to said frame centerline;

a hydraulic pump, having hydraulic fluid, operatively connected to the engine means and hydraulically connected to each of the dual action hydraulic cylinders; and means for selectively delivering hydraulic fluid from the hydraulic pump to each of the dual action hydraulic cylinders at variably selectable pressure.

2. The self propelled power trowel, for finishing a concrete surface, of claim 1, wherein the means for selectively delivering hydraulic fluid from the hydraulic pump to each of the dual action hydraulic cylinders at variably selectable pressure, further comprises a plurality of proportional pressure output control valves operatively interconnected between the hydraulic pump and each of the dual action hydraulic cylinders.

3. A self propelled power trowel, for finishing a concrete surface, which comprises:

rigid frame means adapted to be disposed over said concrete surface, said rigid frame means having a front and a rear and defining a centerline from front to rear:

engine means for powering said power trowel attached to the frame means;

a pair of rotor assemblies for frictionally contacting is said concrete surface and supporting said frame means thereabove, tiltably connected to the frame means and operably connected to the engine means;

at least three pairs of single action hydraulic cylinders, with one pair of said single action hydraulic cylinders operably interconnected between the rigid frame and each rotor assembly for selectively and independently tilting each rotor assembly toward and away from the centerline of the frame, and the third pair of single action hydraulic cylinders operably interconnected between the rigid frame and one of the rotor assemblies for tilting said rotor assembly fore and aft, parallel to said frame centerline;

a hydraulic pump, having hydraulic fluid, operatively connected to the engine means and hydraulically connected to each of the single action hydraulic cylinders; and means for selectively delivering hydraulic fluid from the hydraulic pump to each of the single action hydraulic cylinders at variably selectable pressure.

4. The self propelled power trowel, for finishing a concrete surface, of claim 3, wherein the means for selectively delivering hydraulic fluid from the hydraulic pump to each of the single action hydraulic cylinders at variably selectable pressure, further comprises a plurality of proportional pressure output control valves operatively interconnected between the hydraulic pump and each of the single action hydraulic cylinders.

* * * * *